United States Patent [19]

Cleaveland

[11] 4,005,297

[45] Jan. 25, 1977

[54] VACUUM-TYPE CIRCUIT INTERRUPTERS HAVING HEAT-DISSIPATING DEVICES ASSOCIATED WITH THE CONTACT STRUCTURES THEREOF

[75] Inventor: Charles M. Cleaveland, Irwin, Pa.

[73] Assignee: Westinghouse Electric Corporation, Pittsburgh, Pa.

[22] Filed: Oct. 18, 1972

[21] Appl. No.: 298,689

[52] U.S. Cl. ..... 200/144 B; 174/15 C; 200/289

[51] Int. Cl.[2] ..... H01H 33/66

[58] Field of Search ..... 200/144 B, 166 K; 174/15 C

[56] References Cited

UNITED STATES PATENTS

| | | | |
|---|---|---|---|
| 1,720,413 | 7/1929 | Greenwood | 200/166 K |
| 2,993,971 | 7/1961 | Pflanz | 200/144 B |
| 3,067,279 | 12/1962 | Baker | 200/166 K |
| 3,229,759 | 1/1966 | Grover | 200/166 K |
| 3,261,953 | 7/1966 | Tilman et al. | 200/144 B |
| 3,440,376 | 4/1969 | Rabinowitz | 200/144 B |
| 3,603,753 | 9/1971 | Frink | 200/144 B |
| 3,621,108 | 11/1971 | Cleaveland | 174/15 C |
| 3,662,137 | 5/1972 | Cleaveland | 200/166 K |
| 3,668,354 | 6/1972 | Meermans | 200/166 K |
| 3,764,765 | 10/1973 | Olashaw | 200/166 K |
| 3,769,551 | 10/1973 | Corman et al. | 200/166 K |

*Primary Examiner*—Robert S. Macon
*Attorney, Agent, or Firm*—Willard R. Crout

[57] ABSTRACT

Vacuum "bottles", or vacuum-type circuit interrupters are provided having heat pipes, or reflux condensers provided in the contacts and contact-stems thereof, to remove the generated heat from the interior of the vacuum-interrupter envelope at the contacts to the external parts of the interrupter, and thereby means of heat-dissipating fins, or other heat-dissipator structures disposed at strategic locations, permit the generated heat to be dissipated to the surrounding atmosphere.

By the use of such heat pipes, or reflux condensers, associated with the contact structures of vacuum interrupters, the current ratings of the vacuum interrupters may thereby be increased, and the attained maximum temperatures are considerably reduced, over the situation which would exist if no heat dissipator were employed.

The heat pipes, or the reflux condensers may be provided interiorly of one or both of the separable contacts, and the generated heat at the contacts may be transmitted to externally-disposed cooling fins, or other cooling heat-dissipating structures.

3 Claims, 17 Drawing Figures

FIG.9
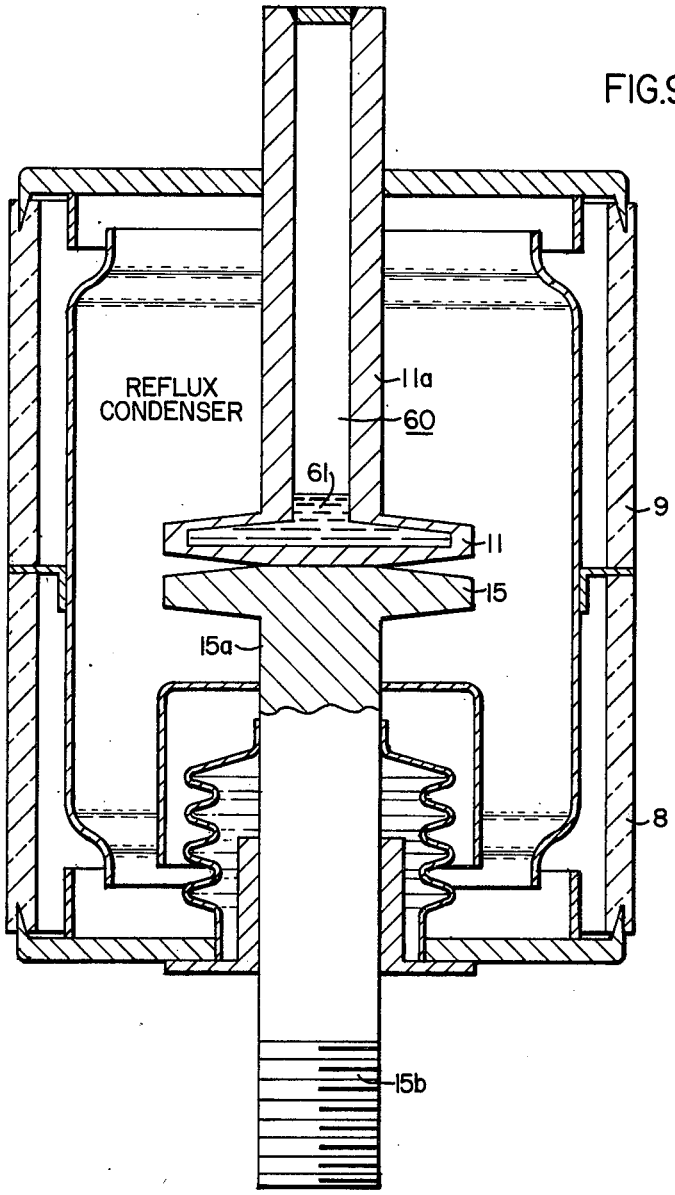
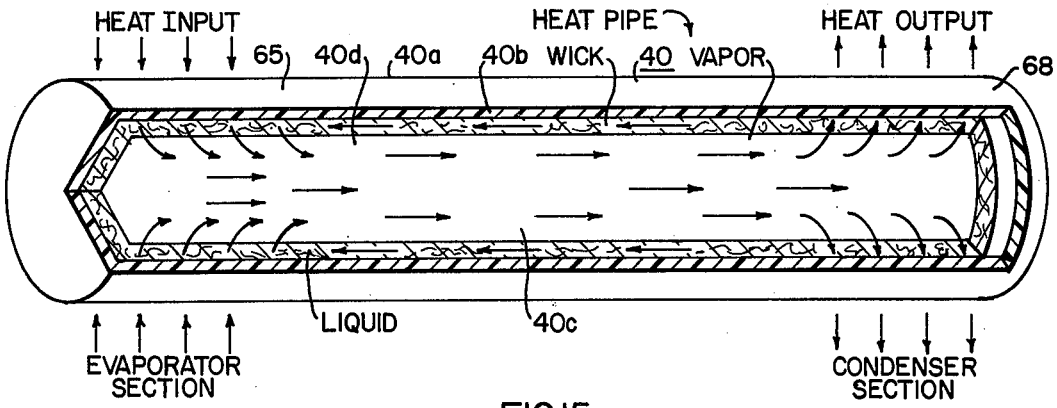
FIG.15

FIG.10
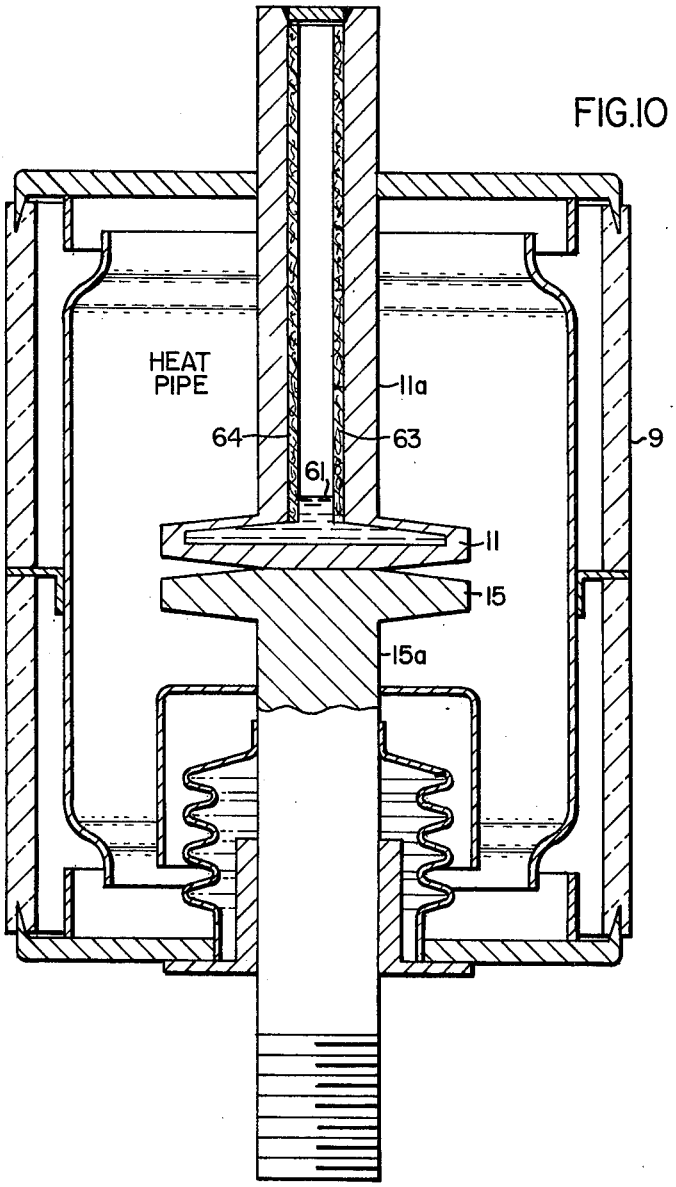
FIG.11
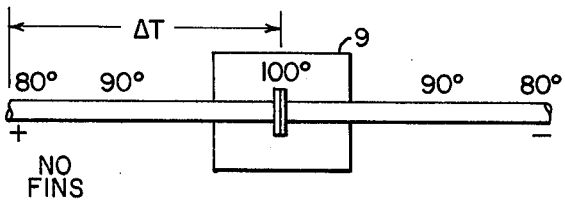
FIG.12
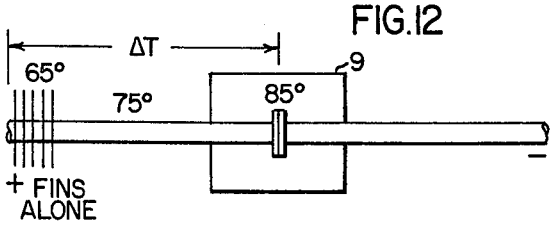
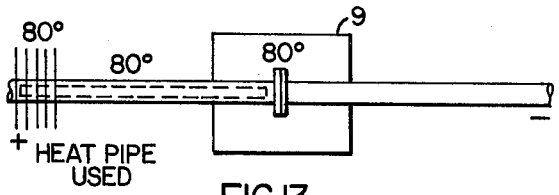
FIG.13
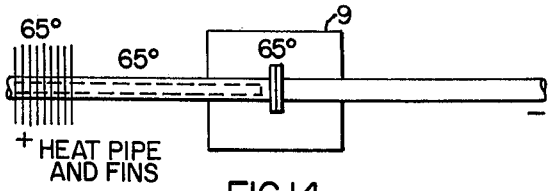
FIG.14

VACUUM-TYPE CIRCUIT INTERRUPTERS HAVING HEAT-DISSIPATING DEVICES ASSOCIATED WITH THE CONTACT STRUCTURES THEREOF

CROSS-REFERENCES TO RELATED APPLICATIONS

Reference may be made to U.S. Pat. application, filed Jan. 21, 1970, Ser. No. 4,479 now U.S. Pat. No. 3,662,137, issued May 9, 1972 to Charles M. Cleaveland, entitled "Switchgear Having Heat Pipes Incorporated In the Disconnecting Structures and Power Conductors", and assigned to the assignee of the instant application.

Regarding different types of heat-dissipating fin structures, reference may be made to U.S. Pat. application filed Jan. 21, 1970, Ser. No. 4,493, entitled "Heat-Conducting Fins for Bus Bars and Other Electrical Conductors", now U.S. Pat. NO. 3,621,108, issued Nov. 16, 1971 to Charles M. Cleaveland, and likewise assigned to the assignee of the instant application.

BACKGROUND OF THE INVENTION

The use of vacuum bottles, or vacuum-type circuit interrupters is increasing in popularity due to their small size, long operational life, high-current interrupting capability, and short travel of the moving contact, which is required for interruption, usually the contact stroke only requiring one-half inch, or less in travel.

In addition, the tremendous amount of development work, which has been conducted by the several manufacturing companies in regard to the contact materials has considerably reduced the hazard of voltage surges occurring on the line, and increasing tremendously the operational life of the interrupters. Today, vacuum interrupters are a reliable component part of much switchgear apparatus. Their use in many structures is exemplified in various types of equipment. For example, vacuum interrupters may be used in submersible equipment, such as set forth in U.S. Pat. No. 3,582,591, issued June 1, 1971 to Robert A. Few. Additionally, reclosing equipment, utilizing vacuum bottles, is today quite prevalent, as exemplified in U.S. Pat. No. 3,601,565, issued Aug. 24, 1971, by Robert A. Few, and likewise assigned to the assignee of the instant application. For high-voltage equipment, the use of vacuum interrupters in series is utilized extensively. Consider, for example, U.S. Patent application filed Oct. 30, 1970, Ser. No. 085,512, by Richard E. Kane and Frank Reese, and assigned to the assignee of the instant application. Also, vacuum interrupters are used for a diversified number of applications, such as interrupting direct current, as set forth in U.S. Pat. Nos. 3,435,288 — Greenwood, 3,489,951 — Greenwood et al, and 3,489,950 — Mishkovsky.

Regardless of the manner of use, vacuum interrupters have difficulty in dissipating the heat, which is generated interiorly of the evacuated envelope at the engaged contacts in the closed position of the devices. It has been found that contact and stem deformation at room temperature in the vacuum bottles, due to impacts during closing operations have been quite prevalent. This indicates that the strength of the soft copper, used as the contact material, is marginal. In addition, deformation of the contact structures, and a small amount of deformation of the contact-stems has occurred. At any rate, the yield strength of annealed copper can decrease, by as much as 4,000 p.s.i., if the temperature were to increase from room temperature to 195° C. according to standard materials handbooks. Also, the creep rate for annealed 1.125 diameter copper at 204° C. under 850 pounds load, is approximately 0.003 inch/year. It is, therefore, desirable to provide a heat-dissipating means, which may be used to transmit the generated heat at the contacts within the vacuum-bottle envelope to a region externally thereof to suitable heat-dissipating cooling structures, to thereby minimize the maximum temperature level attained within the evacuated bottle during continuous passage of current therein. The use of this invention is especially applicable to continuous current ratings of vacuum interrupters that are 3000 A. or more. It should be pointed out that higher continuous ratings of vacuum interrupters are now limited since the diameter of the moving stem is limited. Larger stem diameters are undesirable because of the increased mass that has to be accelerated by the operating mechanism and also because the bellows would be increased in diameter which would increase cost. The heat pipe offers increased current rating without increasing mass or bellows diameter.

SUMMARY OF THE INVENTION

According to the present invention, heat pipes and/or reflux condensers may be associated with the separable contacts and contact-stems of vacuum bottles, or vacuum type circuit interrupters. In addition, heat-dissipating cooling fins are strategically located, so as to provide an external heat-dissipating cooling means for permitting the rapid dissipation of heat to the surrounding atmosphere.

The heat pipes, or reflux condensers may extend internally of one or both of the separable contacts, and the innermost point of the heat pipe, or heat reflux condenser may extend very close to the actual contact area itself.

In the case of a reflux condenser or a heat pipe, the heating reservoir may comprise a considerable portion of the contact area itself, so as to be in close proximity to the point of maximum heat generation within the vacuum interrupter.

By the use of heat pipes, or reflux condensers, the mass and the size of the contact stems may be considerably reduced. Moreover, during normal current transmission, the parts will run considerably cooler than otherwise.

BRIEF DESCRIPTION OF THE DRAWINGS

FIG. 9 illustrates a modified interrupter having a contact construction in which a reflux condenser is associated with the upper stationary contact of the vacuum-type interrupter;

FIG. 10 is a modified-type of interrupter construction involving a heat pipe disposed in the stationary contact stem and employing a wick construction, the contacts being illustrated in the closed-circuit position;

FIG. 11 illustrates diagrammatically the temperature gradient in a vacuum interrupter when no heat pipe is utilized;

FIG. 12 illustrates the construction of FIG. 11, wherein a fin apparatus is utilized, and the modified temperature gradient resulting therefrom;

FIG. 13 illustrates the reduced temperatures of the interrupter of FIGS. 11 and 12 following the insertion of a heat pipe therein;

FIG. 14 illustrates the improvement by the addition of more fins in the construction of FIG. 13, with a consequent modification of the contact and stem temperatures;

FIG. 15 is a partial sectional perspective view illustrating the details of the heat exchanger, or heat pipe, utilized in the present invention; and, FIG. 16, illustrates a graph of a typical heatpipe temperature profile with a transfer of 3000 watts at 600° C. using sodium fluid in a one-inch stainless steel heat pipe.

DESCRIPTION OF THE PREFERRED EMBODIMENTS

Figure 1:
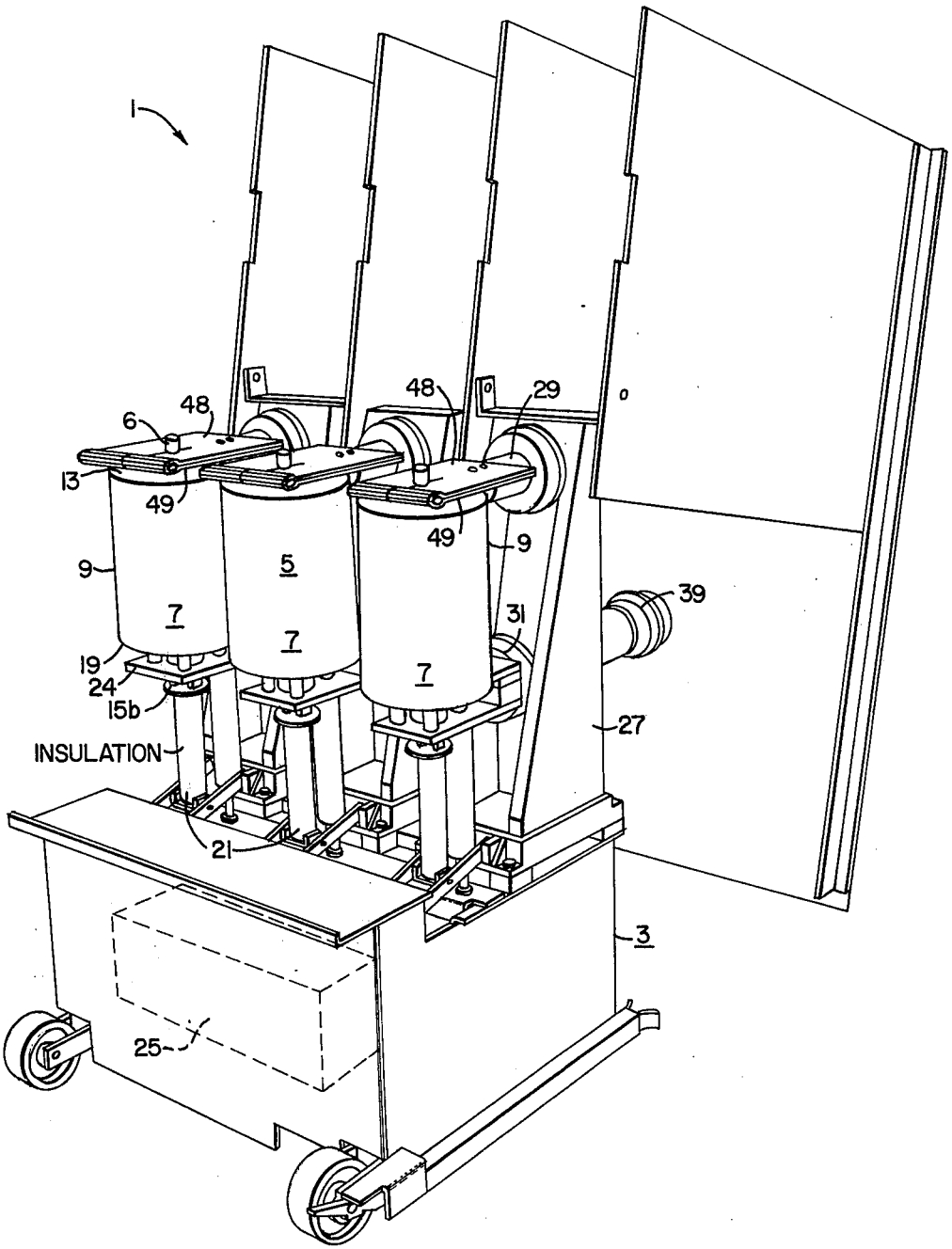
FIG. 1 is a perspective view of a roll-in type metal-clad switchgear apparatus embodying the principles of the present invention.

Referring to the drawings, and more particularly to FIG. 1 thereof, the reference numeral 1 generally designates a roll-in type of truck-mounted switchgear. As well known by those skilled in the art, such equipment is employed in conjunction with metal-clad cubical structures, not shown, but reference may be made to U.S. Pat. No. 3,603,753 — Frink for a further teaching of the utilization of such type of metal-clad equipment.

As shown in FIG. 1, the truck, designated by the reference numeral 3, mounts a three-phase circuit interrupter 5, each of the pole-units 7 of which utilizes a vacuum bottle or vacuum-interrupter construction 9. Each such vacuum bottle, or vacuum-type circuit interrupter 9 is of the type well known in the art. Reference may, for example, be made to U.S. Pat. Nos. 3,667,871 — Hundstad and 3,592,987 — Lempert et al for a detailed description of the general method of construction and operation of such types of vacuum interrupters 9.

Figure 2:
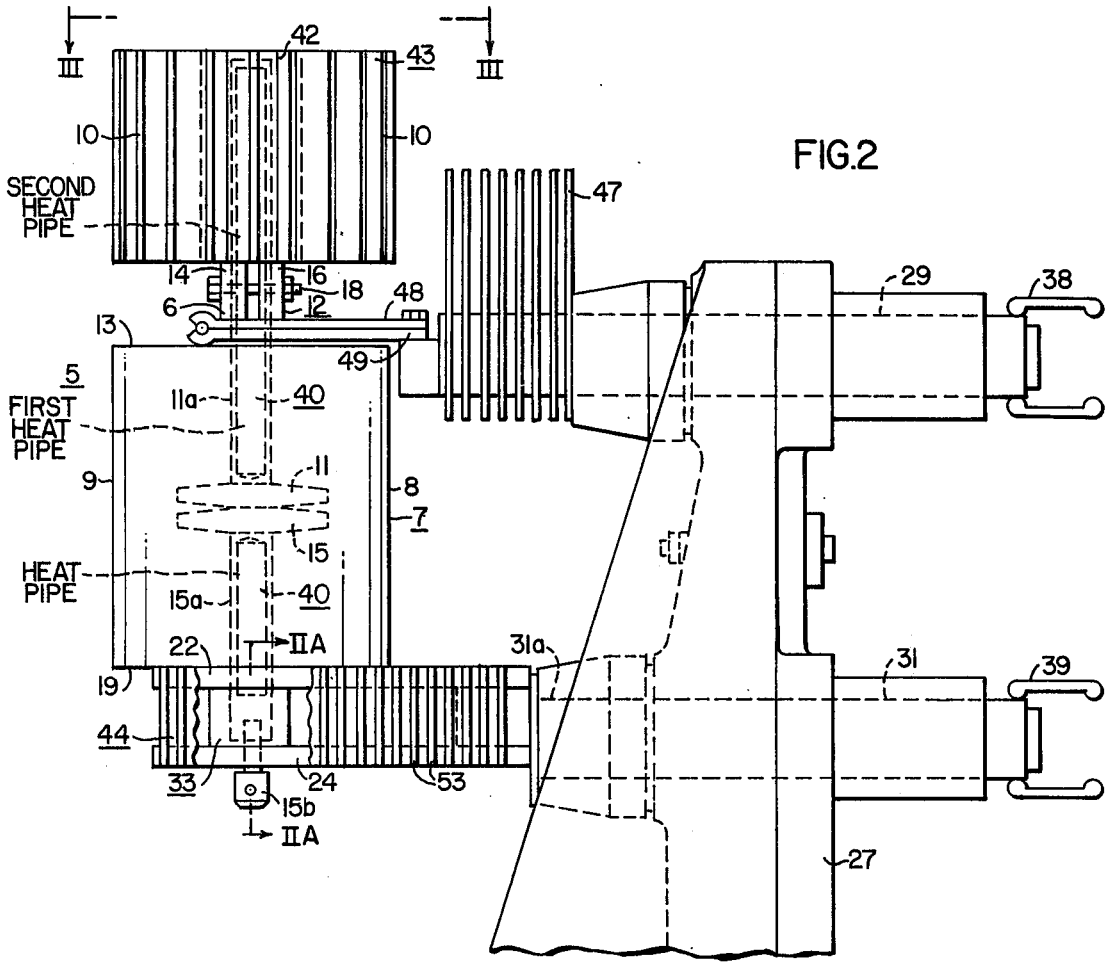
FIG. 2 is an enlarged detailed fragmentary view of the interrupting portion of the equipment illustrated in FIG. 1, showing in more detail the use of heat pipes provided interiorly within the contact-stems of the vacuum interrupter of FIG. 1, the contacts being illustrated in the closed-circuit position.

As is illustrated in FIG. 2, the upper end of the vacuum interrupter 9 constitutes the stationary contact end 6, and, as shown in FIG. 2, the stationary contact 11 is supported by a contact stem 11*a* to the upper end plate 13 of the interrupter 9. The lower contact 15 is movable, and generally comprises a contact supported on a movable contact-stem 15*a*, the latter being sealed to a bellows 17 (FIG. 4), the other end of which is sealed to the lower end plate 19 of the vacuum interrupter 9. Preferably, an insulating operating rod 21 (FIG. 1) actuates the lower end 15*b* (FIG. 2) of the movable contact-stem 15*a* to cause the actuation thereof. An operating mechanism 25 (FIG. 1), not shown, is also supported by the truck 3. It may be of a standard mechanism type, and constitutes no part of the present invention. Reference may be made, for example, to a typical operating mechanism, such as set forth and claimed in U.S. Pat. No. 3,182,332 issued May 11, 1965 to Russell E. Frink and Paul Olsson, and assigned to the assignee of the present application. Also note U.S. Pat. No. 3,254,186 — Fischer in this connection.

An insulating upstanding porcelain support 27 generally supports, in a horizontal position, the laterally-extending terminal studs 29, 31 of the device, the upper end of which is mechanically and electrically connected to the upper stationary contact-stem 11*a* of the vacuum interrupter 9. The lower terminal stud 31 is electrically connected to the lower movable contact 15 of the interrupter 9 by means of contact-stem 15*a*, so that, generally, there results a "loop" circuit comprising the upper terminal stud 29, upper stationary contact-stem 11*a*, upper stationary contact 11, lower movable contact 15, lower movable contact-stem 15*a*, mounting-block construction 33, flexible laterally-extending leaf supports 22, 24, to the inner end 31*a* of the lower terminal stud 31.

During the opening and closing operations, as will be readily apparent, the mechanism 25 (FIG. 1) functions to effect generally upward and downward movements of the insulating operating rods 21, which open and close the movable contacts 15 within the several vacuum-interrupting devices 9. Preferably, the three pole-units 7 operate in unison, a tie-bar construction being utilized to simultaneously effect the opening and closing movements of the three insulating operating rods 21 associated with the three interrupter pole-units 9 of the device 1.

As well known by those skilled in the art, the truck-mounted circuit interrupter 1 is removable within cubicles, not shown, which provide vertically-spaced stationary primary disconnecting contacts, which electrically mate with the clusters of contact fingers 38, 39, which comprise, generally, the movable primary disconnecting contacts forming a part of the truck-mounted circuit-breaker unit 1.

Figure 4:
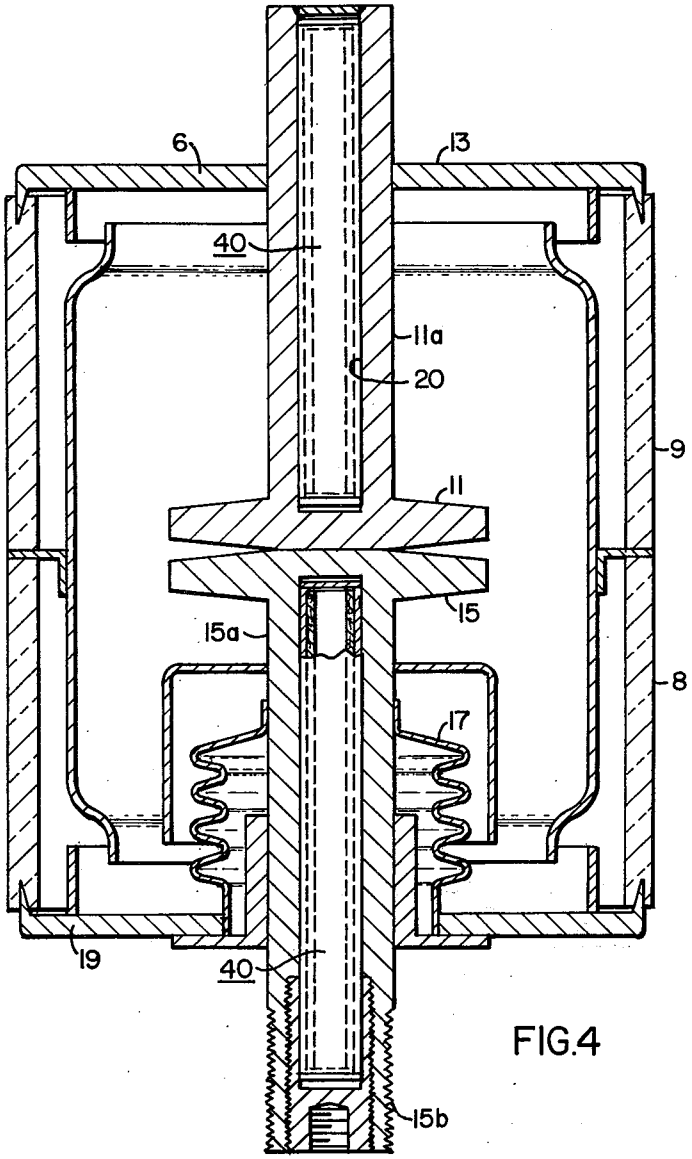
FIG. 4 is an enlarged vertical sectional view taken through the vacuum bottle of FIGS. 1 and 2, indicating the longitudinal bores provided in the two contact-stems having the self-contained heat pipes inserted therein.

FIGS. 2 and 4 show, in more detail, the internal construction of the vacuum interrupter 9 of FIG. 1, and illustrate the incorporation within the contact stems 11*a*, 15*a* of a pair of heat pipes 40. In addition, the fin structures 43, 44 (FIG. 2), which are associated with the two heat pipes 40, facilitate the dissipation to the surrounding atmosphere of the transferred heat generated within the evacuated envelope 8 at the separable contacts 11, 15.

The theory and operation of such heat pipes is set forth in detail, and described in U.S. Pat. No. 3,662,137 issued May 9, 1972, to Charles M. Cleaveland, entitled "Switchgear Having Heat Pipes Incorporated In The Disconnecting Structures and Power Conductors", and assigned to the assignee of the instant application. The teachings and disclosure of this U.S.

Pat. No. 3,662,137 are incorporated herein by reference.

As will be apparent from a study of FIG. 2 of the drawings, it will be readily discernable that the heat generated at the closed contacts 11, 15 will be transferred, by the heat-pipe construction 40, to the external fins 43, 44, which are located externally of the envelope 8, and are extended in an upstanding manner, as shown. The fins 43, 44 comprise a number of vertically-radially arranged metal plates 10, which assist in dissipating the heat to the surrounding atmosphere. Reference may be had to FIGS. 9 and 11 of the foregoing U.S. Pat. No. 3,662,137 in this connection.

Figure 3:
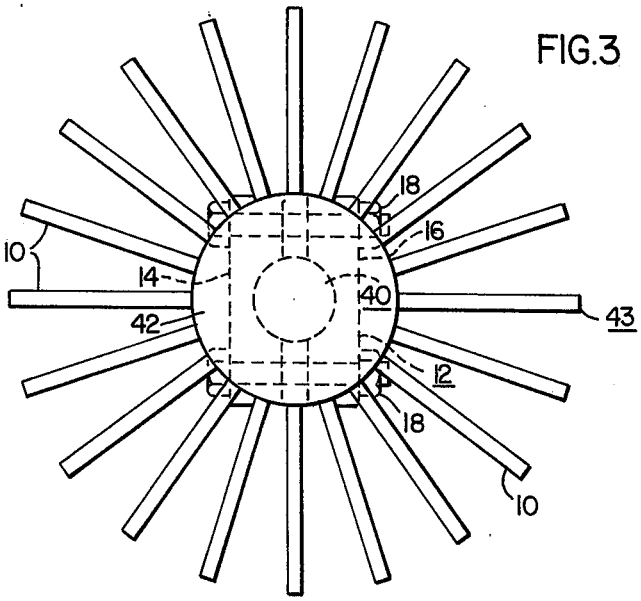
FIG. 3 is a top plan view taken along the line III—III of FIG. 2.

In more detail, it will be observed from an inspection of FIGS. 2 and 3, that the upper fin construction 43 comprises a core 42, which is joined, by a clamp joint 12, to the upper end of the stationary contact-stem 11*a*. The clamping construction 12 is more clearly illustrated in FIGS. 2 and 3, and generally comprises a pair of coacting contact blocks 14 and 16 clamped together by clamping bolts 18. The heat pipe 40 may extend up into the fins 10, either by way of a long contact-stem 11*a* on the bottle, or interrupter unit 9, or as an alternate construction, a separate additional heat pipe 41 may be provided within the core 42 of the fin construction 43 as shown in FIG. 6 of the drawings.

To additionally dissipate the heat, another fin construction may be employed, designated by the reference numeral 47, surrounding the inner end of the contact stud 29, to cool the connector plates 48 and 49, which firmly clamp the stationary contact-stem 11*a* of the bottle 9. Reference may be made to U.S. Pat. application filed Aug. 16, 1971, Ser. No. 172,075 by Norman Davis, and assigned to the assignee of the instant application for detailed information regarding the coacting clamping connector plates 48 and 49, and the teachings of this application are incorporated herein by reference.

With reference to FIG. 3 of the drawings, it will be observed that there are a multiplicity of radially-outwardly-extending cooling fin plates 10 extending outwardly from the core 42 in heat-transmission relationship therewith, to provide thereby a heat-dissipating structure 43.

Figure 5:
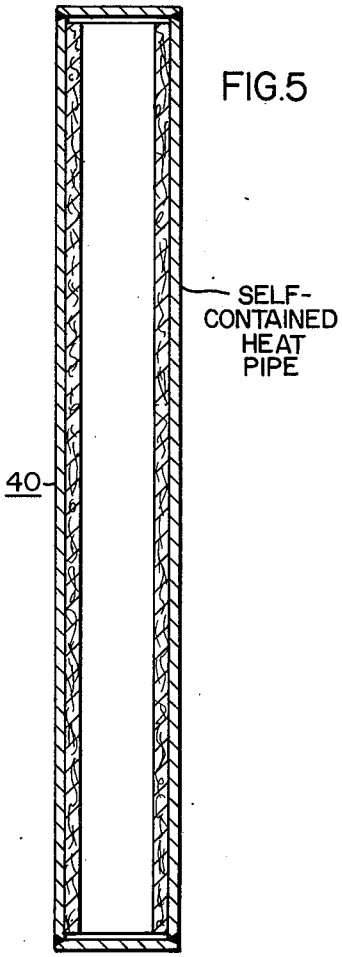
FIG. 5 illustrates the self-contained heat pipe used in the construction of FIG. 4.
Figure 6:
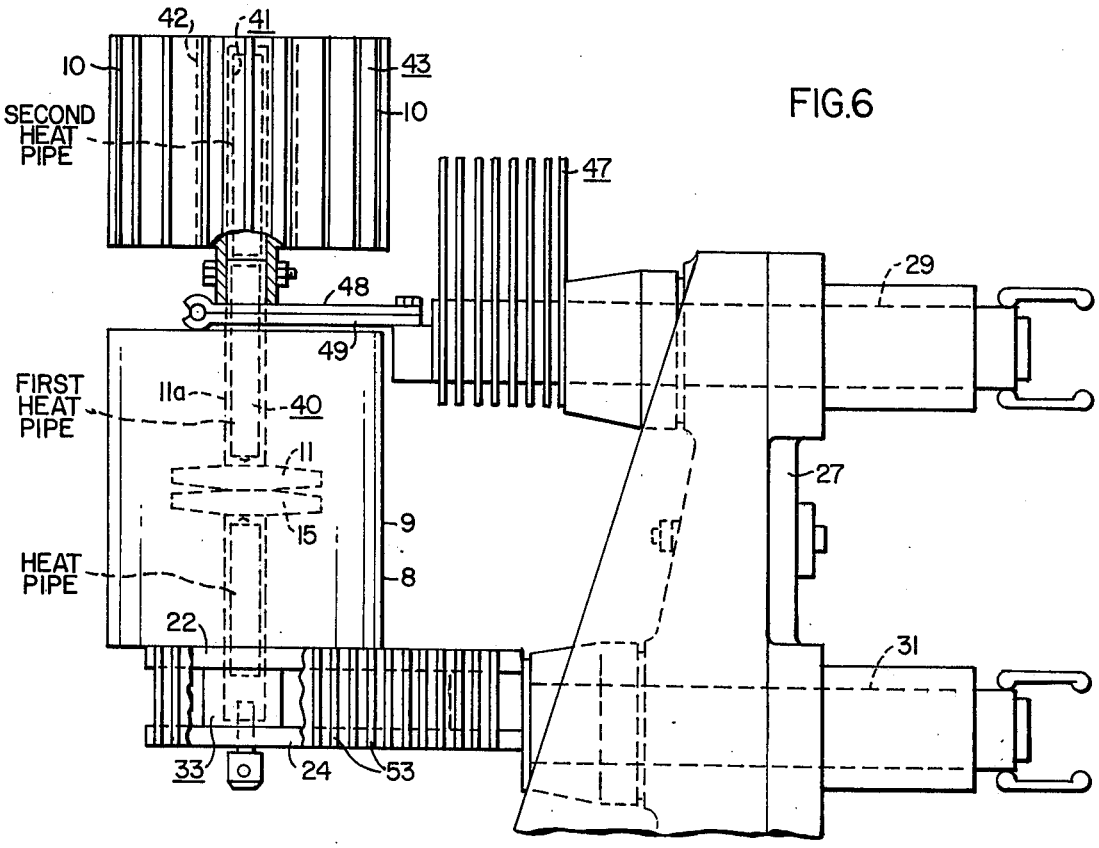
FIG. 6 is a modification showing three heat pipes, with two heat pipes associated with the upper stationary contact structure.

A plurality of vertically-extending spaced fin-plates 53 may be associated with the two spaced lower supporting plates 22, 24, or as an alternate, the construction set forth in FIGS. 5 and 6 of U.S. Pat. No. 3,662,137 may be utilized, if desired.

As will be apparent, the heat pipe 40 may be extended up into the core 42 of the fin construction 43, or, alternatively, a separate heat pipe 41 may be provided in the core 42 of the fins 43, as illustrated in FIG. 6.

An additional fin location 47 may be utilized either in addition to, or as substitution of the fin construction 43 of FIG. 2.

An additional fin construction 44 may be associated with the lower two supporting straps 22, 24 to assist in dissipating the heat to the surrounding atmosphere, which is transferred from the lower movable contact 15 downwardly along the movable contact stem 15*a*, and across a sliding contact 33*a*, to the tube 33, and further to the straps 22 and 24. Further description of this sliding contact is obtainable in Ser. No. 42,114 filed Nov. 20, 1972, Ser. No. 308,091 by the present inventor, or King application Ser. No. 308,092.

FIG. 5 shows the construction of FIG. 4, wherein a sealed type of vacuum pipe 40 is inserted within a machined bore 20 as a separate item within the contact stems 11*a*, 15*a*. The sealed heat pipe 40 is illustrated more clearly in FIG. 5 of the drawings. Contact is made between the heat pipe wall and the stem by a press fit or heat shrink fit or by threading.

Figure 8:
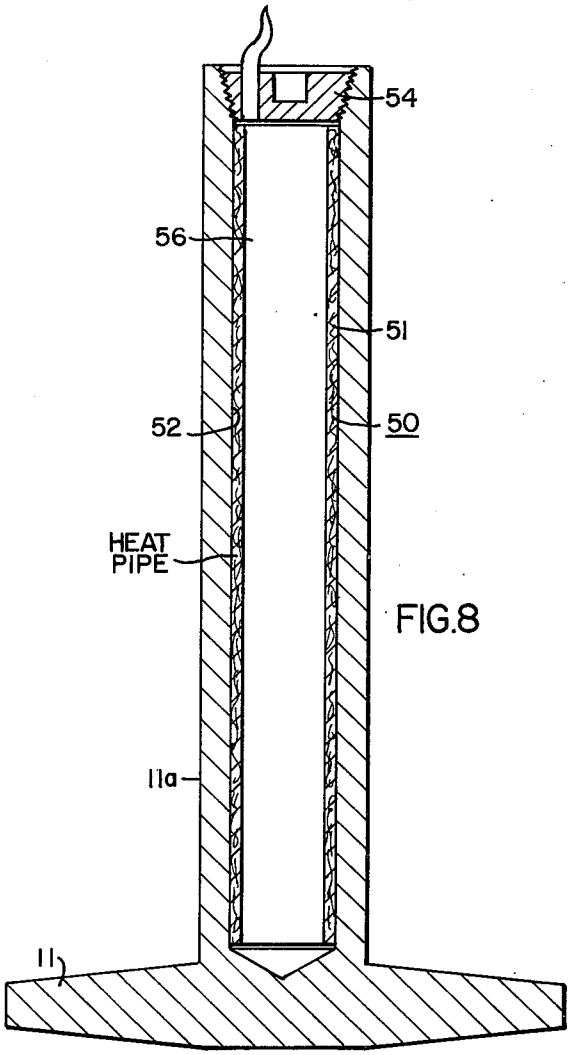
FIG. 8 illustrates a modified-type of "built-in" heat pipe, which may be used in substitution of the self-contained one employed in FIG. 4.

FIG. 8 illustrates a modified-type of heat pipe 50 in which a wick 51 is inserted within the machined bore 52 of the contact stem 11*a*, and a sealed plug, or brazed cap 54 may be employed to retain the working fluid 56 in the wick 51.

FIG. 9 illustrates a modified-type of heat-dissipating device, wherein the reflux condenser 60 is used in the upper stationary contact stem 11*a* of the device. The heat input area is, of course, appreciable because of the large area of contact with the stationary contact 11. The relative large area inside the contact 11 increases the heat transfer from the contact stem 11*a* to the fluid 61. Again the reflux condenser 60 could be in the moving contact 15, if the bottle 9 were mounted in an inverted position, now shown.

FIG. 10 illustrates a modified-type of construction similar to that of FIG. 8, but a wick 64 is utilized in conjunction with a heat pipe 63. As shown, the working fluid 61 has a large area of intimate contact with the stationary contact 11, and the wick 64 will assist in the condensation and return of the working fluid 61. Since the wick is utilized, this construction can be used in either the moving or non-moving contact regardless of orientation.

Figure 7:
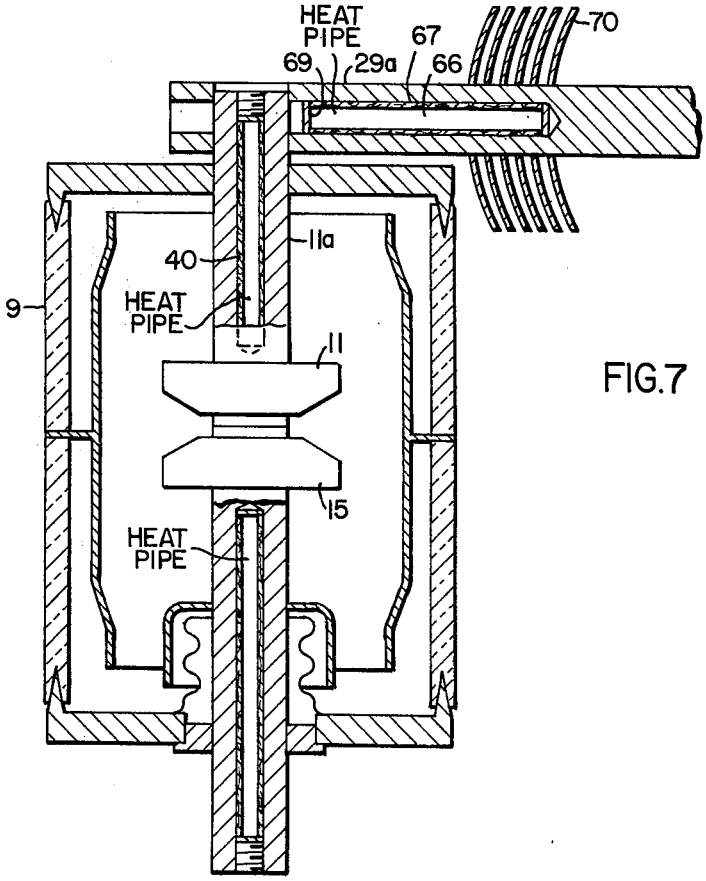
FIG. 7 illustrates a modified-type of interrupter construction in which a heat pipe is employed in the breaker stud, in conjunction with the heat pipes supplied in the vacuum bottle contact-stems.

FIG. 7 illustrates a modified-type of interrupter construction in which a heat pipe 66 is provided in the breaker stud 29*a*. This may be utilized with, or without, the heat pipe 40 in the vacuum bottle 9 itself. As shown, a wick 67 is utilized in conjunction with the heat pipe 66 and a seal 69 is provided. The heat pipe 66 provides a transfer of heat from the area adjacent the stationary contact stem 11*a* over to the breaker stud 29*a*, where fins 70 are employed to effect a rapid heat transfer to the surrounding atmosphere.

It is pointed out that a heat pipe without fins, or some kind of heat-dissipator 43 or 47 is of little benefit in keeping breaker temperature down. Therefore, fins 10 must be close to the heat pipe 40 to get rid of the heat carried by the heat pipe. The arrangement, illustrated in FIG. 7, shows that a heat pipe 66 in the breaker stud 29*a* can be used to get the heat to the fins 70, because the fins 70 may have to be remote to the vacuum interrupter 9 for geometrical reasons. In some cases, a heat pipe 66 in the breaker stud 29*a* may be almost equivalent to the construction set forth in FIG. 2, eliminating the need for a heat pipe within the vacuum interrupter 9 but a further necessity for heat extraction may be required for the higher-current rating interrupters.

FIGS. 11–14 illustrate cases of heat generated in vacuum bottles to illustrate comparison of the temperatures resulting from modified structures. FIG. 11 illustrates the construction where no fins are utilized. FIG. 12 illustrates the construction in which fins alone are added. FIG. 13 illustrates the situation where a heat pipe is added to the construction. FIG. 14 illustrates the addition of fins. It will be noted that in FIG. 12, the contact and stem temperature was reduced but the $\Delta T$ remains the same. When the heat pipe is added (FIG. 13), the $\Delta T$ approaches zero, and the fins and stem now run hotter, but the contacts cooler. Then, finally, more fins are added (FIG. 14) to bring the temperature down to the desired 65° C. rise at all points. This is a somewhat hypothetical case meant to clarify what happens to temperature, when everything is held relatively constant, except for the fins and heat-pipe additions.

From the foregoing description it will be apparent that there has been provided various constructions in which heat pipes and reflux condensers are associated with the contact structures 11, 15 of vacuum interrupters 9. In addition, where appropriate, separate heat pipes may be utilized to effect transfer of the heat from the contact stem to remote portions of the equipment. As illustrated, fins are desirable to facilitate heat dissipation to the surrounding atmosphere.

For details of the heat exchanger 40 reference is made to FIG. 15 which shows a sectional view of a heat exchanger 40 of the type used in this invention. The heat exchanger 40 comprises an outside container 40*a*, which is completely closed and evacuated. A hollow cylindrical wick 40*b* lines the inside of the container 40*a*, and the hollow space 40*c* inside the hollow wick 40*b* contains a liquid, such as a liquid fluoridated hydrocarbon material, or even water.

The operation of this heat exchanger 40 is as follows. The application of heat to the heat input end 65 of the container 40*a* causes the fluoridated hydrocarbon material 40*d*, or other working liquid, such as water, to evaporate from the wick 40*b*, and also increases the vapor pressure at the heat input end 65. As a result of this increased vapor pressure at the heat input end 65, the vapor due to the vaporization of the water material, or other working liquid moves through the inside of the container, carrying heat energy toward the heat output end 68 of the container. Heat is removed from the container at the heat output end 68 of the container by any of the means which will be described hereinafter, and the vapor condenses and goes back into the wick. The condensed vapor returns as liquid fluoridated hydrocarbon, or water, to the heat input end 65 of the heat exchanger 40 by capillary action. A wick return for the liquid fluoridated hydrocarbon, or water is more efficient and is preferred where there is no gravity force to return the liquid; however, where there is gravity force to return the liquid, the wick may be eliminated.

The working fluid will boil and condense at roughly the same temperature if it is held at the correct pressure causing the temperature along the entire length of the container to be uniform. The heat exchanger, shown in FIG. 15, may be constructed entirely of insulating materials, if desired; for example, the container 40*a* may be made of ceramic material, the wick may be made of fiber glass and the insulating liquid may be fluoridated hydrocarbon material, or even water. A detailed discussion of the type of heat exchanger, as shown in FIG. 15, is disclosed in "Scientific American", May 1968 pages 38 through 46.

FIG. 15 illustrates the working of a typical heat pipe 40. The heat pipe is a closed evacuated chamber with a wire mesh wick around its inner surface, for example. The wick is saturated with a working fluid such as water, for example. Heat applied to one end 65 of the pipe causes the working fluid to vaporize, increasing the vapor pressure at that end. As a result, the vapor moves through the core of the pipe and carries heat energy to the other end 68. As the vapor condenses, it releases its heat of vaporization, returns as a liquid by way of the wick, and is drawn back to the evaporator end 65 by the capillary action of the wick.

It will be apparent that in utilizing a heat pipe, it is desirable to afford a highly-efficient heat sink, which may assume the form of a finned upper and lower castings, as illustrated in FIG. 2 of the drawings.

Figure 16:
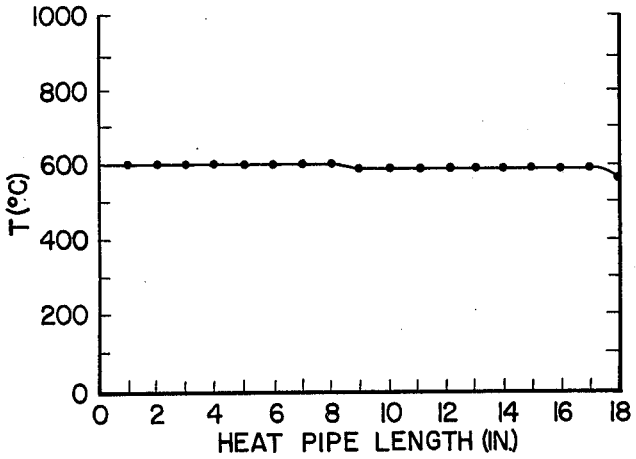
Figure 2A:
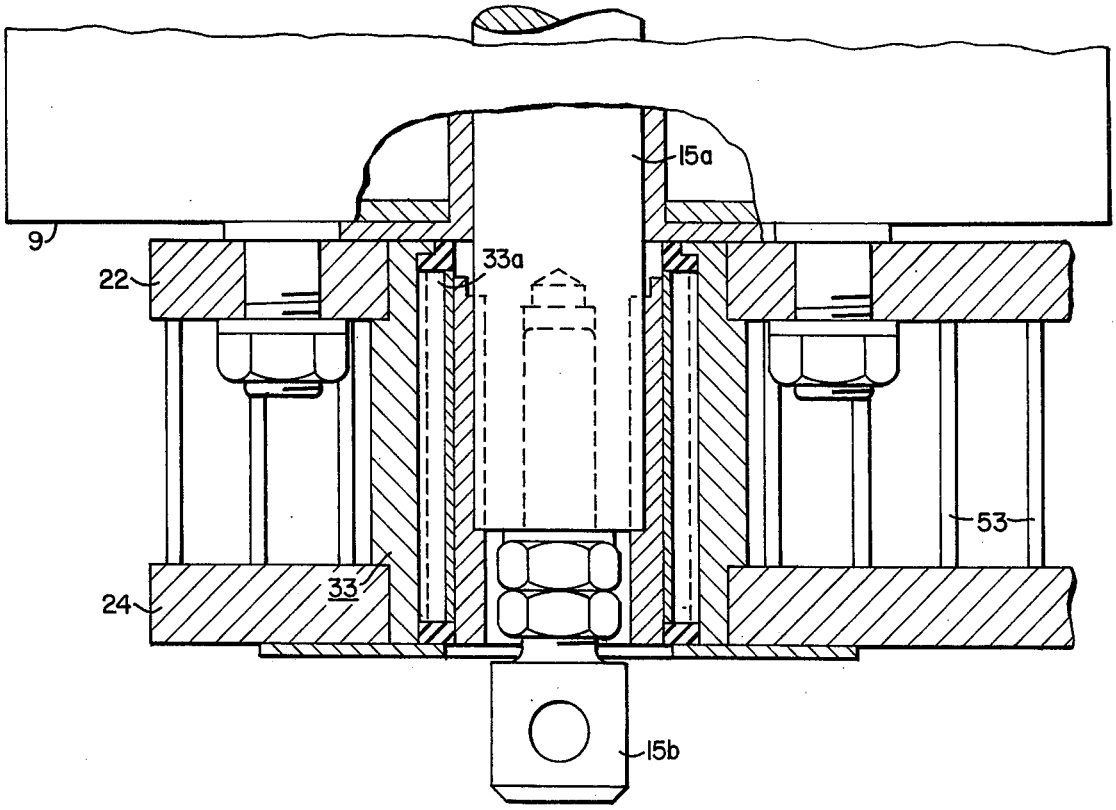
FIG. 2A is an enlarged fragmentary sectional view taken along the line IIA—IIA of FIG. 2.

The isothermal profile of a typical heat pipe 22 is illustrated in FIG. 16 of the drawings, which shows the conditions for the transfer of 3000 watts at 600° C., using sodium fluid in a one-inch diameter stainless steel heat pipe. However, various vaporizable fluids, such as water, may be utilized, as well known by those skilled in the art.

The advantages of a heat pipe are that it is self-pumping, and the fluid water circulates without external assistance. A heat pipe can transmit over 500 times more heat than a solid copper rod of the same cross-section. Moreover, a heat pipe provides an enclosed durable, tested, and safe heat transfer system, which operates equally well over a wide temperature range.

It is to be clearly understood that the heat pipe may be used without a capillary wicking structure for certain applications; however, for other applications, the use of a wicking structure 40*b*, which may be either of a metal screen construction, or a suitable felt or sponge, may be desirable. As stated hereinbefore, the heat, upon entering one area 65 of the heat pipe, causes the fluid water within that area to evaporate. The vapor traversing the chamber and condensing at the heat-sink areas 68 gives up a large heat of vaporization. The fluid water is then drawn back to the evaporator sections 65 by capillary forces within the wick structure 24.

Although there has been illustrated and described specific structures, it is to be clearly understood that the same were merely for the purpose of illustration, and that changes and modifications may be readily made therein by those skilled in the art, without departing from the spirit and scope of the invention.

I claim:

1. A vacuum-type circuit interrupter including means defining an evacuated envelope and a pair of separable contacts disposed therewithin, means for effecting the opening and closing motions of at least one of said separable contacts, heat-exchanger means disposed within the contact-stem of at least one of said separable contacts, a heat pipe provided in the contact-stem of one of the contacts, and externally-provided finned cooling structure being provided having a core, and a second heat pipe being disposed in end-to-end relationship with the first said heat pipe.

2. A vacuum-type circuit interrupter including means defining an evacuated envelope and a pair of separable contacts disposed therewithin, means for effecting the opening and closing motions of at least one of said separable contacts, heat-exchanger means disposed within the contact-stem of at least one of said separable contacts, a contact stud assisting in supporting the evacuated envelope, and a heat pipe being associated with said contact stud.

3. The combination according to claim 2, wherein finned cooling structure is associated with said contact stud.

* * * * *